US008511501B2

(12) United States Patent
Onken, Jr. et al.

(10) Patent No.: US 8,511,501 B2
(45) Date of Patent: Aug. 20, 2013

(54) THEFT PROOF LID FOR GREASE BIN WITH DUAL LOCKING FEATURE AND METHOD FOR INSTALLING

(76) Inventors: Donald R. Onken, Jr., Easton, IL (US); Joseph D. Onken, Mason City, IL (US)

( * ) Notice: Subject to any disclaimer, the term of this patent is extended or adjusted under 35 U.S.C. 154(b) by 842 days.

(21) Appl. No.: 12/604,497

(22) Filed: Oct. 23, 2009

(65) Prior Publication Data

US 2011/0095040 A1 Apr. 28, 2011

(51) Int. Cl.

| | |
|---|---|
| ***B65D 51/04*** | (2006.01) |
| ***B65D 45/00*** | (2006.01) |
| ***E05C 19/18*** | (2006.01) |

(52) U.S. Cl.

USPC ..... 220/315; 220/324; 220/210; 220/826; 220/833; 220/908; 292/148; 292/288; 292/289; 292/DIG. 11; 70/77; 70/101

(58) Field of Classification Search

USPC ..... 220/210, 315, 318, 323, 324, 826, 220/833, 908; 292/288, 289, 45, 148, 259 R, 292/DIG. 11; 70/77, 101

See application file for complete search history.

(56) References Cited

U.S. PATENT DOCUMENTS

| | | | | |
|---|---|---|---|---|
| 3,508,363 | A * | 4/1970 | Crivello et al. | 52/20 |
| 4,319,762 | A * | 3/1982 | Streit et al. | 280/79.2 |
| 5,085,341 | A * | 2/1992 | Hodge | 220/811 |
| 5,248,057 | A | 9/1993 | Taylor | |
| 5,927,107 | A | 7/1999 | Mitchell | |
| 6,227,405 | B1 | 5/2001 | Andreoli et al. | |
| 6,722,711 | B2 * | 4/2004 | Kitzis | 292/145 |
| 6,755,053 | B1 * | 6/2004 | Dias | 70/14 |
| 2008/0276662 | A1 * | 11/2008 | Hyatt et al. | 70/2 |

* cited by examiner

*Primary Examiner* — Anthony Stashick
*Assistant Examiner* — James N Smalley
(74) *Attorney, Agent, or Firm* — Ronald E. Greigg; Philip L. Bateman

(57) ABSTRACT

The theft proof lid according to the invention provides a lockable lid for a container, in particular, a standard 200-300 gallon grease bin used by most rendering and bio-fuel companies. The theft proof lid keeps thieves from stealing the bin contents. The lid is permanently installed onto the bin. A dual locking feature of the lid allows for easy pumping or dumping of the bin. First, locking pins for locking and unlocking the front corners of the lid are provided. A front half of the lid is foldable relative to a rear half of the lid, so that the front half may be unlocked and opened for pumping out the contents of the bin. A center locking bar is provided to lock the rear half of the lid from being opened. The locking bar is removed when the bin is to be lifted and dumped, allowing the lid to swing open on a back lid hinge, particularly when the lid is in a folded position.

12 Claims, 4 Drawing Sheets

FIG. 4
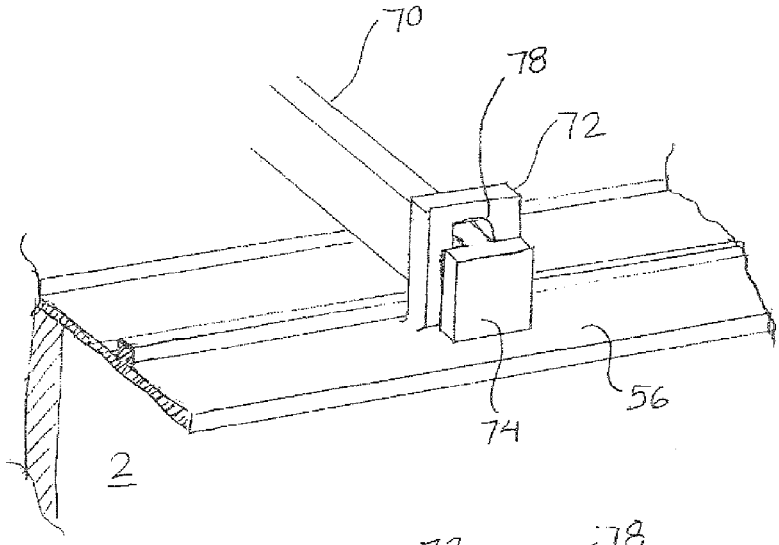
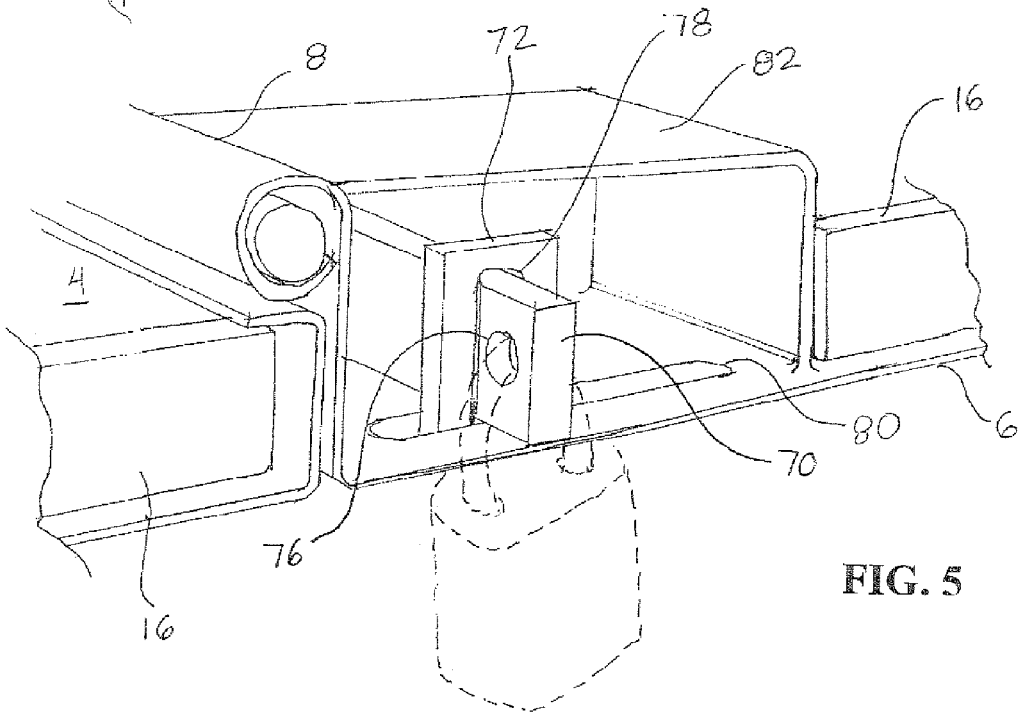
FIG. 5

THEFT PROOF LID FOR GREASE BIN WITH DUAL LOCKING FEATURE AND METHOD FOR INSTALLING

BACKGROUND OF THE INVENTION

1. Field of the Invention

The invention relates to a lid for a bin, in particular a grease bin.

2. Description of the Prior Art

It is well known in the prior art to collect waste fats, oils and grease from restaurants and other food handling facilities. Standard collection bins are known which are serviced by trucks which pick up and dump the bin, or pump out the bin in for rendering or processing the contents of the bin.

The contents of these bins have become the target of thieves as reuse of the grease has a variety of applications. It has therefore become necessary to find a way to lock the bins to prevent thieves from accessing the contents.

OBJECT AND SUMMARY OF THE INVENTION

The object of the invention is to prevent thieves from stealing grease from a bin while providing easy access to the grease when pumping or dumping the grease from the bin during usual servicing.

In order to prevent theft of grease from a bin, the invention provides security features for the lid of the grease container which is installed on a standard steel grease bin.

The invention relates to a theft proof lid for a grease waste bin. A lid is provided for covering an open top of a waste bin. A hinge disposed on a rear portion of the lid, attaches the lid to a rear portion of the top of the waste bin. The hinge enables the lid to pivot between a closed position in which the open top of the waste bin is covered and an open position in which the open top of the waste bin is uncovered. A first locking feature disposed on a front portion of the lid and of the top of the waste bin, includes at least one cut out hole disposed in the front portion of the lid, at least one mating hole cut into the front portion of the waste bin, the mating hole being in alignment with the cut out hole when the lid is in the closed position, and includes a locking device inserted through the cut out hole and the mating hole which secures the front portion of the lid to the front portion of the waste bin and prevents unauthorized access. A second locking feature disposed on a middle portion of the lid and of the waste bin, includes a locking bar which has ends received by receptacle tabs disposed on the waste bin in the middle portion, and includes locking devices which secure the ends of the locking bar in the receptacle tabs and secures the middle portion of the lid to the middle portion of the waste bin when the lid is in the closed position and the locking bar is installed over the lid.

The theft proof lid for a waste bin further includes reinforcing ribs disposed on each side edge of the lid, each side edge being between the front portion and the rear portion of the lid. The reinforcing ribs are disposed along a substantial length of the lid thereby reinforcing each side edge of the lid.

According to another aspect of the invention, the lid is embodied as a folding lid, having a front part and a rear part hinged together by a center hinge, such that from the closed position the front part of the folding lid is foldable over the rear part.

According to another aspect of the invention, a pour hole is disposed in the front part of the folding lid, and a hinged cover is provided which covers the pour hole when not in use.

According to another aspect of the invention, the locking bar is installed adjacent to and behind the center hinge of the foldable lid, when the lid is in the closed position.

According to another aspect of the invention, the lid is provided with two cut out holes, one each in a front corner of the lid, and the waste bin is provided with two mating holes in a flange thereof.

According to another aspect of the invention, the locking device of the first locking feature is embodied by a pin, having a pin top larger than the cut out hole, a pin part insertable through the cut out hole and mating hole, and a lock hole in an end of the pin part, and embodied by a lock inserted into the lock hole.

According to another aspect of the invention, the locking bar is embodied as an extended bar with an end stop at one end of the bar and a lock hole at an other end of the bar, the receptacle tabs are embodied as slotted tabs welded onto side edges of the waste bin which extend through aligned side slots provided in the lid and the bar is inserted through slots of the slotted tabs, and the locking devices of the second locking feature are embodied by the end stop of the bar and a lock inserted into the lock hole of the bar.

According to another aspect of the invention, the front part of the foldable lid is secured to the rear part of the foldable lid when the front part is folded over the rear part by a securing device which prevents the front part of the lid from pivoting relative to the rear part of the lid.

A method for installing the theft proof lid to the waste bin, includes the following steps. The lid is centered on the waste bin. The hinge of the lid is attached to the rear portion of the waste bin. A front portion of a waste bin flange is marked through the at least one cut out hole in the lid for positioning the mating hole to be drilled. Center side flanges of the waste bin are marked through side slots in the lid for positioning the receptacle tabs for the locking bar, and for welding the receptacle tabs to the side flanges of the waste bin. The receptacle tabs are tacked to the waste bin flange to the marked areas with the lid opened to ensure the locking bar when held in position in the receptacle tabs, fits properly. The receptacle tabs are welded to the side flanges of the waste bin. The mating hole(s) is drilled in the waste bin flange at the marked area(s). The lid is closed and the fit of the locking device of the first locking feature is checked for proper alignment. The waste bin is locked via the locking device of the first locking feature. The ends of the locking bar are secured in the receptacle tabs with the locking devices of the second locking feature.

BRIEF DESCRIPTION OF THE DRAWINGS

Those and other features and advantages of the invention will be better understood by the following detailed description taken in conjunction with the accompanying drawings, in which:

FIG. 4 illustrates a perspective side view of the center locking bar from one side of the bin according to a second locking feature of the invention;

FIG. 5 illustrates a perspective side view of the locking bar from the opposite side of the bin on the theft proof lid.

DETAILED DESCRIPTION OF THE PREFERRED EMBODIMENT

Figure 1:
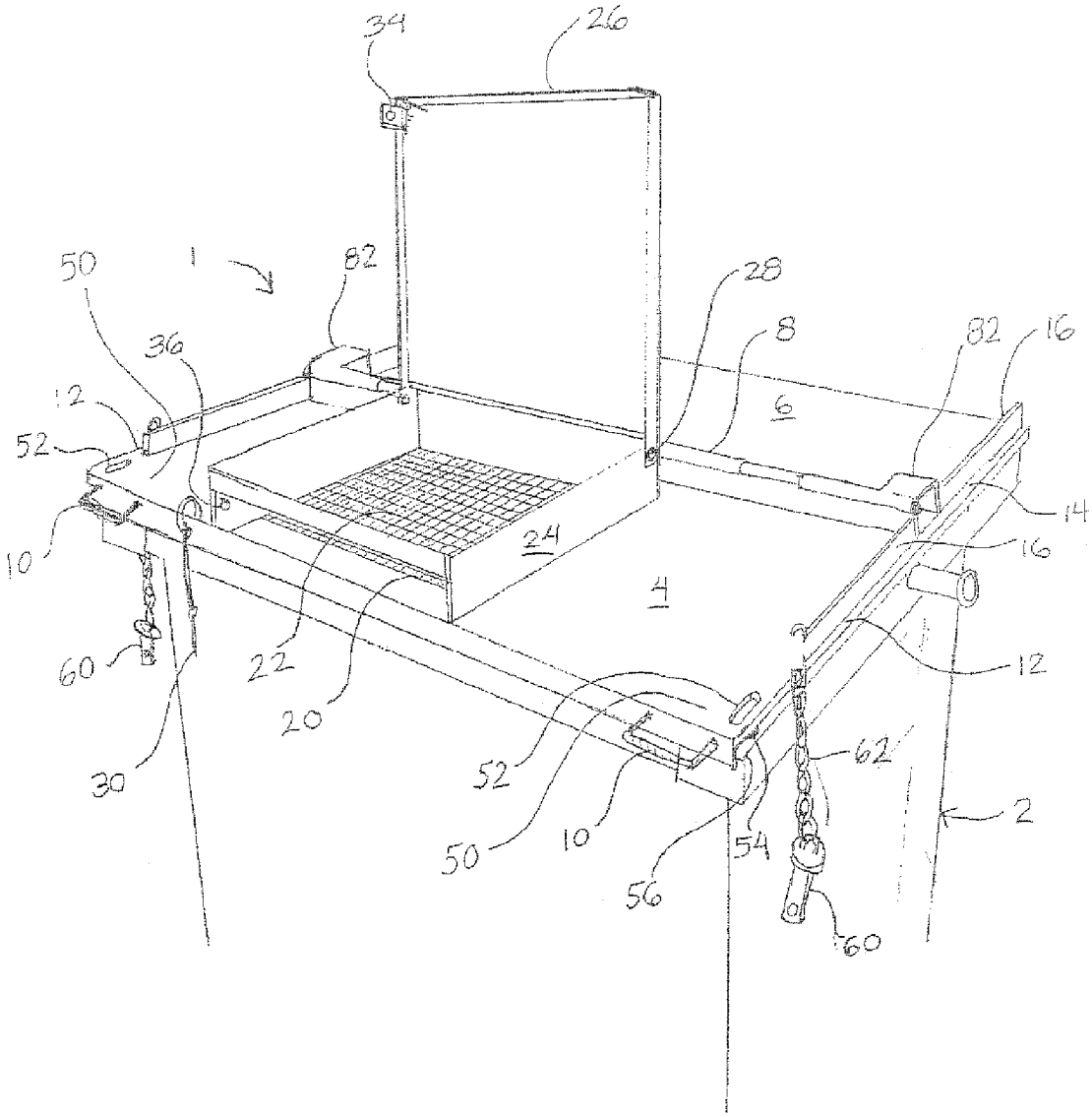
FIG. 1 illustrates a perspective front view of the theft proof lid according to the invention in a closed position on a standard bin.

Now referring to the drawings there is shown a theft proof lid 1 in accordance with this invention. FIG. 1 shows a front view of the theft proof lid 1 installed onto a standard grease bin 2. The theft proof lid 1 has a front half 4 and a rear half 6 which are hinged together by a center hinge 8 which permits the front half 4 of the lid 1 to be folded back onto the rear half 6. The back edge of the lid 1 is hinged to the rear of the container, which will be described herein later. Handles 10 are provided on the front half 4 of the lid 1 to facilitate a person when opening the lid 1. The front half 4 and rear half 6 are reinforced on their respective side edges 12, 14 by a steel 1"×¼" reinforcing straps or ribs 16 welded thereon. This prevents the edges 12, 14 from being pried up when the lid is in a locked state.

On the top of the front half 4 of the lid 1 has a pour hole 20 which is provided with a 1" mesh screen 22. The mesh of the screen 22 is large enough to allow thick oils and grease to pass through the screen 22, but small enough to prevent theft and/or trash from being put into the bin 2. The pour hole 20 is surrounded by side walls 24 which keep pour splatter contained over the pour hole 20. A cover 26 for the pour hole is attached to the side walls 24 in a pivoting manner via a pivot connection 28. The cover 26 can be secured by a pin 30 which is shown attached to the front half 4 of the lid 1 by a small chain. The pin 30 passes through a pin hole 34 in the cover 26 and a pin hole 36 in the side wall 24 to secure the cover 26 so that it does not pivot open when folding the lid 1 back.

Figure 2:
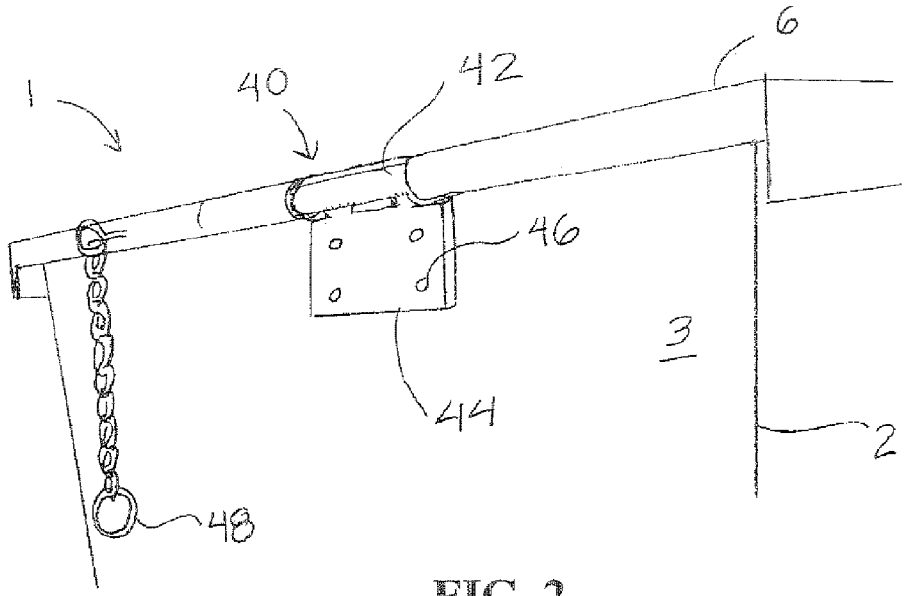
FIG. 2 is a perspective rear view of the lid hinged to the bin of FIG. 1.

Referring now to FIG. 2, it can be seen that the lid 1 is hinged to a back wall 3 of the bin 2 by means of a back hinge 40. The back hinge 40 is built into the back of the rear half 6 of the lid 1. A hinge rod 42 is attached to a mounting plate 44 which is bolted and welded to a back wall 3 of the bin 2 by bolts 46. The rear half 6 of the lid 1 then can be pivoted about the back hinge 40 about the hinge rod 42 to completely uncover the lid 1 from the bin 2. A chain with a loop 48 attached to the back of the lid 1 can be looped on a hook (not shown) on the inside of the front half 4 of lid 1 to secure the folded lid 1 on top of the rear half 6 of the lid 1, described herein later.

Figure 3:
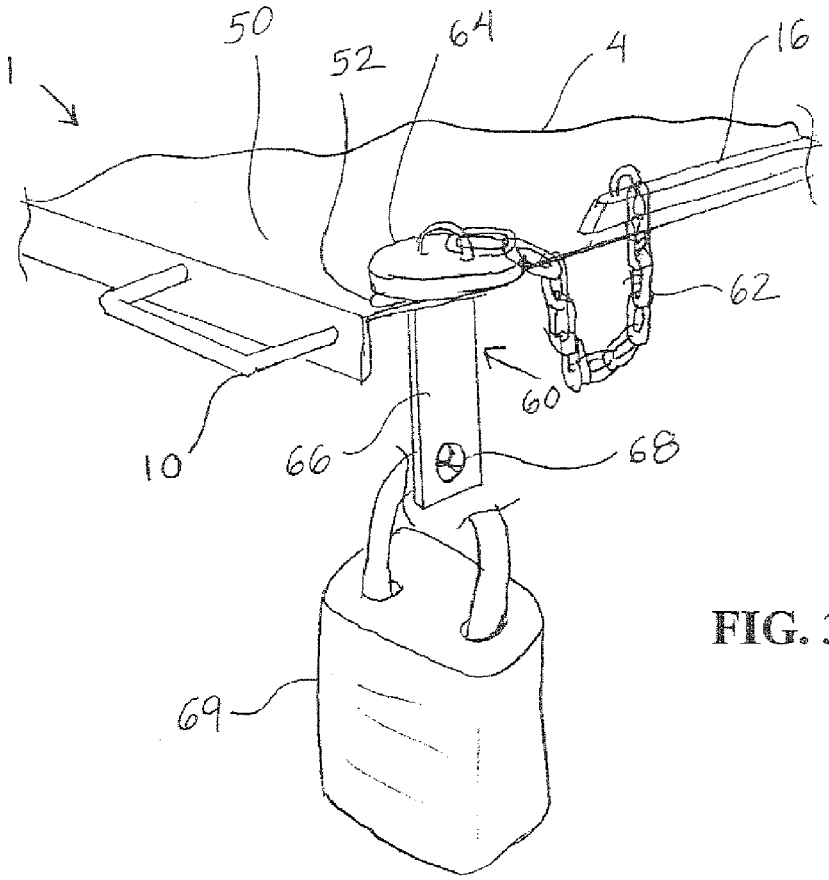
FIG. 3 illustrates a perspective view of the corner locking pins for the theft proof lid according to a first locking feature of the invention.

Referring now to FIG. 3, details of the first locking feature according to the invention will be described. FIG. 3 shows a close up of a front corner 50 of the lid 1 without the bin 2 for simplicity. The two front corners 50 of the front half 4 of the lid 1 have cut out holes 52 that align with pin holes 54 made in the front corners of a flange 56 the bin 2 (FIG. 1). A locking pin 60 is attached at each side of the lid 1 by a chain 62, shown here as attached at the reinforcing strap 16, for example. Each locking pin 60 has a top part 64, attached to the chain 62, which is larger than the cut out hole 52 and a pin part 66 which is able to pass through the cut out hole 52. The pin part 66 is shown as a flat rectangular tab with a lock hole 68 in its end to accommodate a lock 69. The pin holes 54 are provided in the bin flange 56 which surrounds the tops of the edges of the bin 2. The locking pins 60 pass from outside the lid 1 through the cut out holes 52 in the lid 1 and through the pin holes 54 in the bin flange 56. Then the lock 69 is then passed though the lock hole 68 in the bottom of each locking pin to secure the front corners 50 of the lid 1 to the bin 2.

FIG. 4 and FIG. 5 show the details of the second locking feature according to the invention. A locking bar 70 for the lid 1 is provided to lock the center of the lid 1, to a point on the bin flange 56 directly behind the center hinge 8, to prevent the center of the lid 1 near the center hinge 8 from being pried up. Slotted tabs 72 are welded to the sides of the bin flange 56. The locking bar 70 has an end stop 74 at one end and a lock hole 76 at the other end. The end stop 74 is larger than slots 78 provided in the slotted tabs 72. FIG. 4 shows the locking bar slid 70 through one of the slotted tabs 72, without the lid shown, for simplicity.

The rear half 6 of the lid 1 has side slots 80 which align with the slotted tabs 72 and a bracket 82 surrounding each side slot 80. The brackets 82 provide protection around the slotted tabs 72 and side slots 80 and access to the area there around, as well as a stop for the front half 4 of the lid 1 when it is folded back onto the rear half 6 of the lid 1. The slotted tabs 72 pass through the side slots 80 in the lid 1 and enable the locking bar 70 to be passed though the slotted tabs 72. After the locking bar is passed through the side slots 80, a lock (shown in phantom) is passed through the lock hole 76 on the free end of the locking bar 70 to secure it from being removed.

Figure 6:
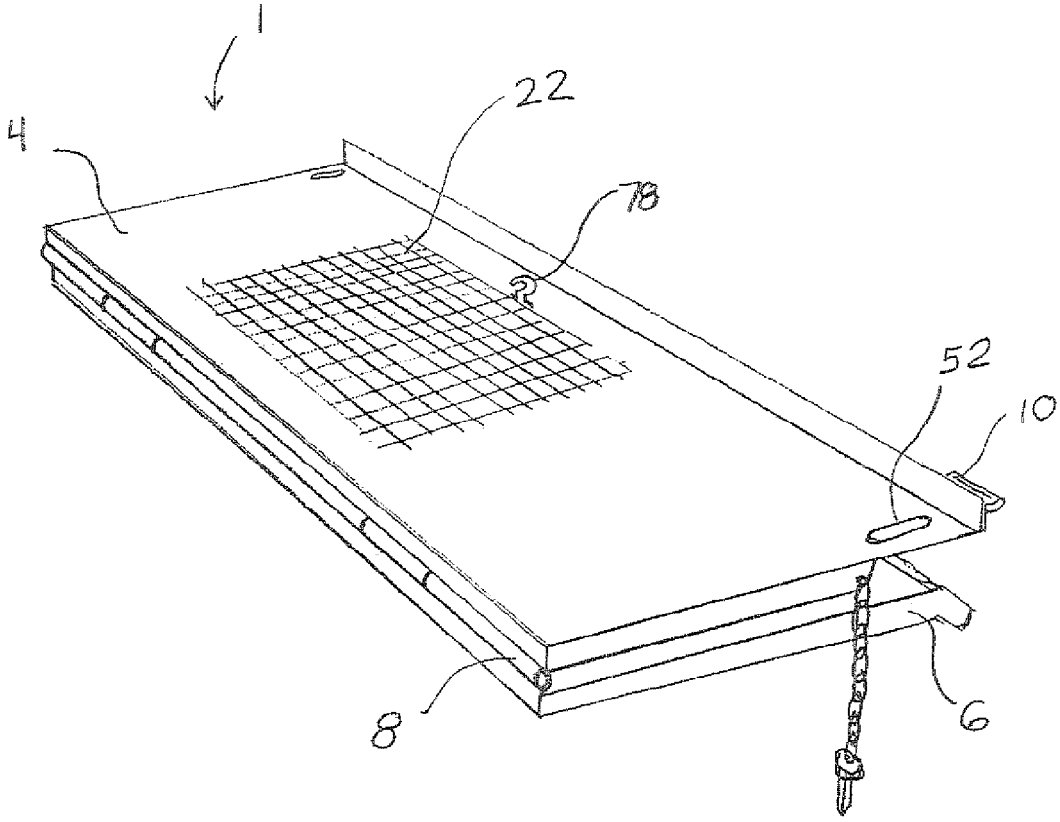
FIG. 6 illustrates a perspective view of the theft proof lid in a secured folded open position.

FIG. 6 shows the lid 1 in an open, folded back position. It can be seen that the inside of the front half 4 of the lid 1 is provided with a hook 78. The chain 48 and loop attached to the back of the lid 1 (FIG. 2) is shown hooked onto the hook 78. This prevents the front half 4 of the lid 1 from pivoting relative to the rear half 6 of the lid 1, for example when the bin 2 is being dumped and the lid 1 pivots on the back hinge 40.

The theft proof lid 1 is designed to be permanently installed on a bin 2. The lid 1 is installed by centering the lid 1 on the bin 2. The mounting plate 44 for the back hinge 40 on the back edge of the lid 1 is then bolted to the back wall 3 of the bin 2. Nuts are welded to the bolts in order to prevent the lid 1 from being uninstalled. The two front corners of the bin 2 flange are marked through the cut out holes 52 in the lid 1 for positioning the pin holes 54 to be drilled. The center sides of the bin flange 56 are marked through the side slots 80 in the lid 1 for positioning the slotted tabs 72 for the locking bar for welding to the bin 2 flange. The slotted tabs 72 are then tacked to the bin flange 56 with the lid 1 folded back to ensure the locking bar 70 when held in position in the tabs, fits properly. Then the slotted tabs 72 are welded to the bin 2. After the pin holes are cut, the lid 1 is folded closed and the fit of the locking pins are checked for proper alignment. Locks are secured in the through holes in the lock pins. Once the bin 2 is pinned and locked at the front corners, the locker bar is slid 1 through the tabs and locked.

To pump the bin 2 out, the pour hole lid 1 is pinned to prevent the lid 1 from opening when folding the front half 4 of the lid 1 back. The lid 1 is unlocked at the front corners and the lid 1 is folded halfway back. To dump the bin 2, the lid 1 must first be folded back and chained to prevent damage. The chain on the back edge of the lid 1 is hooked onto the hook inside the top front half 4 of the lid 1. After the lid 1 is chained and the locking bar is removed, the bin 2 can be safely lifted and dumped by a truck in the usual manner. The lid 1 will pivot on the back hinge 40 on the back of the lid 1 as the bin 2 is dumped.

The foregoing relates to a preferred exemplary embodiment of the invention, it being understood that other variants and embodiments thereof are possible within the spirit and scope of the invention, the latter being defined by the appended claims.

We claim:

1. A theft proof lid for a waste bin, in particular a grease waste bin comprising:

a folding lid for covering an open top of a waste bin, the lid having a front part and a rear part hinged together by a center hinge, such that from the closed position the front part of the lid is foldable over the rear part;

a rear hinge disposed on a rear portion of the lid, which rear hinge attaches the lid to a rear portion of the top of the waste bin, the rear hinge enabling the lid to pivot between a closed position in which the open top of the waste bin is covered and an open position in which the open top of the waste bin is uncovered;

a first locking feature disposed on a front portion of the lid and of the top of the waste bin, including at least one cut out hole disposed in the front portion of the lid, at least one mating hole cut into the front portion of the waste bin, the mating hole being in alignment with the cut out hole when the lid is in the closed position, and including a locking device inserted through the cut out hole and the mating hole which secures the front portion of the lid to the front portion of the waste bin and prevents unauthorized access; and a second locking feature disposed on a middle portion of the lid and of the waste bin, including a locking bar which has ends received by receptacle tabs disposed on the waste bin in the middle portion, and including locking devices which secure the ends of the locking bar in the receptacle tabs and secures the middle portion of the lid to the middle portion of the waste bin when the lid is in the closed position and the locking bar is installed over the lid.

2. The theft proof lid for a waste bin according to claim 1, further comprising reinforcing ribs disposed on each side edge of the lid, each side edge being between the front portion and the rear portion of the lid, the reinforcing ribs being disposed along a substantial length of the lid thereby reinforcing each side edge of the lid.

3. The theft proof lid for a waste bin according to claim 1, wherein a pour hole is disposed in a front portion of the lid, and a hinged cover is provided which covers the pour hole when not in use.

4. The theft proof lid for a waste bin according to claim 1, wherein the locking bar is installed adjacent to and behind the center hinge of the foldable lid, when the lid is in the closed position.

5. The theft proof lid for a waste bin according to claim 1, wherein the lid is provided with two cut out holes, one each in a front corner of the lid, and the waste bin is provided with two mating holes in a flange thereof.

6. The theft proof lid for a waste bin according to claim 1, wherein the locking device of the first locking feature is embodied by a pin, having a pin top larger than the cut out hole, a pin part insertable through the cut out hole and mating hole, and a lock hole in an end of the pin part, and embodied by a lock inserted into the lock hole.

7. The theft proof lid for a waste bin according to claim 5, wherein the locking device of the first locking feature is embodied by a pin, having a pin top larger than the cut out hole, a pin part insertable through the cut out hole and mating hole, and a lock hole in an end of the pin part, and embodied by a lock inserted into the lock hole.

8. The theft proof lid for a waste bin according to claim 1, wherein the locking bar is embodied as an extended bar with an end stop at one end of the bar and a lock hole at an other end of the bar, the receptacle tabs are embodied as slotted tabs welded onto side edges of the waste bin which extend through aligned side slots provided in the lid and the bar is inserted through slots of the slotted tabs, and the locking devices of the second locking feature are embodied by the end stop of the bar and a lock inserted into the lock hole of the bar.

9. The theft proof lid for a waste bin according to claim 1, wherein the front part of the foldable lid is secured to the rear part of the foldable lid when the front part is folded over the rear part by a securing device which prevents the front part of the lid from pivoting relative to the rear part of the lid.

10. The theft proof lid for a waste bin according to claim 2, wherein the front part of the foldable lid is secured to the rear part of the foldable lid when the front part is folded over the rear part by a securing device which prevents the front part of the lid from pivoting relative to the rear part of the lid.

11. A theft proof lid for a waste bin, in particular a grease waste bin comprising:

(a) a lid for covering an open top of a waste bin;

(b) a hinge disposed on a rear portion of the lid, which hinge attaches the lid to a rear portion of the top of the waste bin, the hinge enabling the lid to pivot between a closed position in which the open top of the waste bin is covered and an open position in which the open top of the waste bin is uncovered;

(c) a first locking feature disposed on a front portion of the lid and of the top of the waste bin, including at least one cut out hole disposed in the front portion of the lid, at least one mating hole cut into the front portion of the waste bin, the mating hole being in alignment with the cut out hole when the lid is in the closed position, and including a pin inserted through the cut out hole and the mating hole which secures the front portion of the lid to the front portion of the waste bin and prevents unauthorized access, the pin having a top larger than the cut out hole, a pin part insertable through the cut out hole and mating hole, and a lock hole in an end of the pin part, and embodied by a lock inserted into the lock hole; and (d) a second locking feature disposed on a middle portion of the lid and of the waste bin, including a locking bar which has ends received by receptacle tabs disposed on the waste bin in the middle portion, and including locking devices which secure the ends of the locking bar in the receptacle tabs and secures the middle portion of the lid to the middle portion of the waste bin when the lid is in the closed position and the locking bar is installed over the lid.

12. A waste bin and lid assembly comprising:

(a) a waste bin having a top with a front portion, a middle portion, and a rear portion;

(b) a folding lid for covering the open top of the waste bin, the lid having a front part and a rear part hinged together by a center hinge, such that from the closed position the front part of the lid is foldable over the rear part;

(c) a rear hinge disposed on a rear portion of the lid, which rear hinge attaches the lid to the rear portion of the waste bin, the rear hinge enabling the lid to pivot between a closed position in which the open top of the waste bin is covered and an open position in which the open top of the waste bin is uncovered;

(d) a first locking feature disposed on a front portion of the lid and of the top of the waste bin, including at least one cut out hole disposed in the front portion of the lid, at least one mating hole cut into the front portion of the waste bin, the mating hole being in alignment with the cut out hole when the lid is in the closed position, and including a locking device inserted through the cut out hole and the mating hole which secures the front portion of the lid to the front portion of the waste bin and prevents unauthorized access; and (e) a second locking feature disposed on a middle portion of the lid and of the waste bin, including a locking bar which has ends received by receptacle tabs disposed on the middle portion of the waste bin, and including locking devices which secure the ends of the locking bar in the receptacle tabs and secures the middle portion of the lid to the middle portion of the waste bin when the lid is in the closed position and the locking bar is installed over the lid.

* * * * *